US011879234B2

(12) United States Patent
Oasa et al.

(10) Patent No.: US 11,879,234 B2
(45) Date of Patent: Jan. 23, 2024

(54) WORK VEHICLE

(71) Applicant: KOMATSU LTD., Tokyo (JP)

(72) Inventors: Takahisa Oasa, Tokyo (JP); Kiyotaka Ninomiya, Tokyo (JP)

(73) Assignee: KOMATSU LTD., Tokyo (JP)

( * ) Notice: Subject to any disclaimer, the term of this patent is extended or adjusted under 35 U.S.C. 154(b) by 754 days.

(21) Appl. No.: 16/496,094

(22) PCT Filed: Sep. 28, 2018

(86) PCT No.: PCT/JP2018/036430
§ 371 (c)(1),
(2) Date: Sep. 20, 2019

(87) PCT Pub. No.: WO2019/082600
PCT Pub. Date: May 2, 2019

(65) Prior Publication Data

US 2020/0056354 A1 Feb. 20, 2020

(30) Foreign Application Priority Data

Oct. 24, 2017 (JP) ..... 2017-205489

(51) Int. Cl.
*E02F 3/43* (2006.01)
*E02F 9/26* (2006.01)
(Continued)

(52) U.S. Cl.
CPC ..... *E02F 9/265* (2013.01); *E02F 3/283* (2013.01); *E02F 3/422* (2013.01); *E02F 3/434* (2013.01);
(Continued)

(58) Field of Classification Search
CPC . E02F 3/425; E02F 9/26; E02F 9/2004; E02F 3/42; E02F 9/2239; E02F 9/123;
(Continued)

(56) References Cited

U.S. PATENT DOCUMENTS 3,487,958 A * 1/1970 Costa ..... E02F 3/434 414/685
3,726,428 A * 4/1973 Lark ..... E02F 3/432 414/700
(Continued)

FOREIGN PATENT DOCUMENTS

JP 3-5766 U 1/1991
JP 6-185093 A 7/1994
(Continued)

OTHER PUBLICATIONS

The extended European search report for the corresponding European application No. 18870208.8, dated Dec. 11, 2020.
(Continued)

*Primary Examiner* — Edwin J Toledo-Duran
(74) *Attorney, Agent, or Firm* — Global IP Counselors, LLP

(57) ABSTRACT

A work vehicle includes a vehicle body, a work implement including a boom attached to the vehicle body and an attachment attached to a tip end part of the boom, a first actuator configured to rotate the boom up and down, and a controller configured to execute an automatic lowering control in order to automatically rotate and lower the boom. The controller is further configured to set the first actuator to a floating state when it is detected that the attachment has reached a predetermined position during an execution of the automatic lowering control.

20 Claims, 3 Drawing Sheets

(51) Int. Cl.

| | |
|---|---|
| ***E02F 3/28*** | (2006.01) |
| ***E02F 3/42*** | (2006.01) |
| ***E02F 9/20*** | (2006.01) |
| ***E02F 9/22*** | (2006.01) |

(52) U.S. Cl.
CPC ..... *E02F 9/2004* (2013.01); *E02F 9/2041* (2013.01); *E02F 9/2203* (2013.01)

(58) Field of Classification Search
CPC . E02F 5/145; E02F 3/434; E02F 9/264; E02F 9/2253; E02F 9/2228; E02F 3/84; E02F 3/432; E02F 9/265; E02F 3/283; E02F 3/422; E02F 9/2041; E02F 9/2203; E02F 3/43
See application file for complete search history.

(56) References Cited

U.S. PATENT DOCUMENTS

| | | | | |
|---|---|---|---|---|
| 4,286,417 | A * | 9/1981 | Shelton | B24C 3/062 451/92 |
| 5,598,648 | A | 2/1997 | Moriya et al. | |
| 5,642,653 | A | 7/1997 | Hutchison | |
| 5,924,516 | A * | 7/1999 | Sagaser | G05G 11/00 91/363 R |
| 6,871,710 | B1 * | 3/2005 | Darling | E21B 7/022 173/19 |
| 6,938,414 | B1 * | 9/2005 | Bruun | E02F 9/226 60/494 |
| 10,214,875 | B2 * | 2/2019 | Garramone | E02F 9/2285 |
| 2001/0027366 | A1 * | 10/2001 | Ikari | E02F 9/2029 701/50 |
| 2002/0133981 | A1 * | 9/2002 | Menze | B60G 17/019 37/266 |
| 2005/0198949 | A1 * | 9/2005 | Bitter | F15B 11/003 60/413 |
| 2005/0199120 | A1 * | 9/2005 | Bitter | F15B 11/0445 91/446 |
| 2006/0248868 | A1 * | 11/2006 | Otto | A01D 41/141 56/10.2 E |
| 2006/0263189 | A1 * | 11/2006 | Vigholm | E02F 9/2221 414/685 |
| 2009/0038186 | A1 * | 2/2009 | Osswald | B62D 49/085 37/468 |
| 2009/0099737 | A1 * | 4/2009 | Wendte | A01D 41/1243 701/50 |
| 2009/0206589 | A1 * | 8/2009 | Osswald | B62D 21/14 187/234 |
| 2010/0226744 | A1 * | 9/2010 | Trifunovic | E02F 3/434 414/700 |
| 2012/0024146 | A1 | 2/2012 | Saito | |
| 2015/0322648 | A1 * | 11/2015 | Lee | E02F 9/2235 91/437 |
| 2016/0040391 | A1 | 2/2016 | Imaizumi et al. | |
| 2017/0211597 | A1 | 7/2017 | Vigholm et al. | |
| 2018/0148907 | A1 * | 5/2018 | Joo | F15B 21/14 |

FOREIGN PATENT DOCUMENTS

| | | | |
|---|---|---|---|
| JP | 7-102597 | A | 4/1995 |
| JP | 8-27840 | A | 1/1996 |
| JP | 8-9234 | Y2 | 3/1996 |
| JP | 2546294 | B2 | 10/1996 |
| JP | 9-133105 | A | 5/1997 |
| JP | 9-256416 | A | 9/1997 |
| JP | 2001-164596 | A | 6/2001 |
| JP | 3379799 | B2 | 2/2003 |
| JP | 2006-161498 | A | 6/2006 |
| JP | 2010-174546 | A | 8/2010 |
| JP | 5700613 | B1 | 4/2015 |
| WO | 2010/110386 | A1 | 9/2010 |

OTHER PUBLICATIONS

The Office Action for the corresponding Chinese application No. 201880021940.5, dated Oct. 16, 2020.
The International Search Report for the corresponding international application No. PCT/JP2018/036430, dated Dec. 18, 2018.

* cited by examiner

WORK VEHICLE

CROSS-REFERENCE TO RELATED APPLICATIONS

This application is a U.S. National stage application of International Application No. PCT/JP2018/036430, filed on Sep. 28, 2018. This U.S. National stage application claims priority under 35 U.S.C. § 119(a) to Japanese Patent Application No. 2017-205489, filed in Japan on Oct. 24, 2017, the entire contents of which are hereby incorporated herein by reference.

BACKGROUND

Field of the Invention

The present invention relates to a work vehicle and a control method for the work vehicle.

Background Information

Conventionally, an automatic lowering control is performed in a work vehicle such as a wheel loader or a bulldozer for automatically lowering an attachment to a predetermined position for the purpose of repeatedly lowering the attachment to a predetermined lowering position easily and accurately (see Japanese Laid-Open Patent Publication No. H09-133105).

SUMMARY

However, the operator may want to perform leveling work of the ground surface by using the attachment in a grounded state under its own weight (a so-called floating state).

In this case, a large shock occurs when the attachment is lowered under its own weight from a certain height to the ground surface when the attachment comes into contact with the ground.

After the attachment is lowered to the predetermined position by the automatic lowering control described in Japanese Laid-Open Patent Publication No. H09-133105, the shock when the attachment is brought into contact with the ground is limited somewhat when the attachment is lowered to the ground surface under its own weight. However, the operation required to manually bring the attachment to the floating state is complicated after the execution of the automatic lowering control.

Taking into account the above problem, an object of the present invention is to provide a work vehicle and a control method for a work vehicle with which the attachment can be grounded easily.

A work vehicle according to the present invention is provided with a vehicle body, a work implement, a first actuator, and a controller. The work implement includes a boom attached to the vehicle body and an attachment attached to a tip end part of the boom. The first actuator is configured to rotate the boom up and down. The controller is configured to execute an automatic lowering control for automatically rotating and lowering the boom. The controller is configured to set the first actuator to a floating state when it is detected that the attachment has reached a predetermined position during an execution of the automatic lowering control.

According to the present invention, a work vehicle and a control method for a work vehicle can be provided with which an attachment can be grounded easily.

DETAILED DESCRIPTION OF EMBODIMENT(S)

An example of a "work vehicle" to which an "automatic lowering control" according to the present invention is applied will be explained hereinbelow with reference to the drawings. However, the scope of the present invention is not limited to the following embodiments and may be changed as desired within the scope of the technical concept of the present invention. For example, while a wheel loader provided with a bucket as the attachment is cited as an example in the following explanations, the "automatic lowering control" according to the present invention can be widely applied to work vehicles. In addition to a wheel loader, a hydraulic excavator or the like can be cited as the work vehicle. In addition to a bucket, a fork or a grapple can be cited as the attachment.

In the present description, "front" is a term that indicates the forward direction of the work vehicle, and "rear" indicates the reverse direction of the work vehicle. In addition, "left" and "right" are terms relative to the traveling direction when the work vehicle is traveling forward.

Wheel Loader 1

Figure 1:
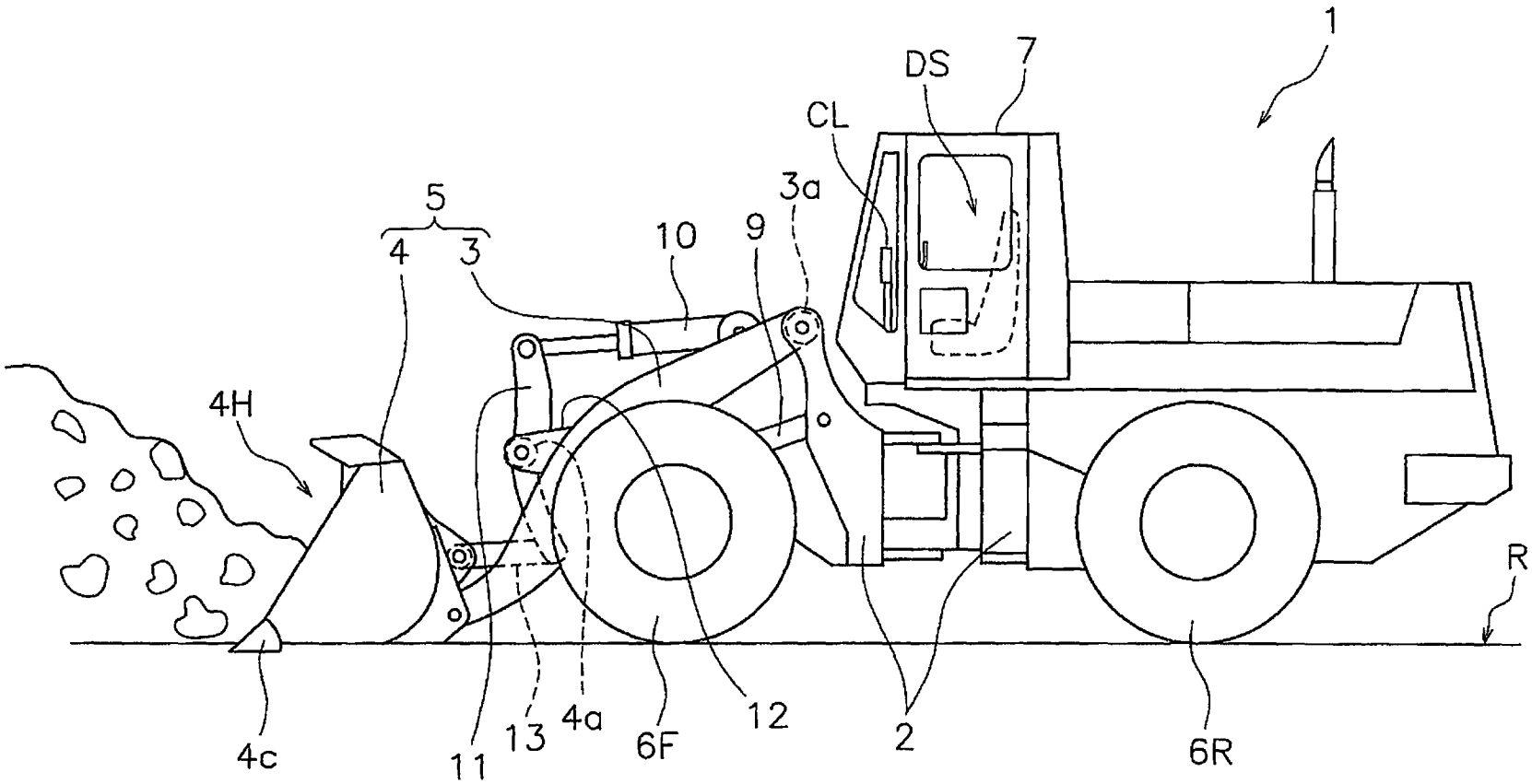
FIG. 1 is side view of a wheel loader.

FIG. 1 is a side view of a wheel loader 1 according to the present embodiment.

The wheel loader 1 is provided with a vehicle body 2, a work implement 5, front wheels 6F, rear wheels 6R, an operating cabin 7, a boom cylinder 9, and a bucket cylinder 10. The boom cylinder 9 is an example of a first actuator and the bucket cylinder 10 is an example of a second actuator.

The work implement, the front wheels 6F, the rear wheels 6R, and the operating cabin 7 are attached to the vehicle body 2. An operator's seat DS on which the operator sits, and an operating lever CL for operating the work implement 5 are disposed inside the operating cabin 7. The operating lever CL is an example of an operating device.

The work implement 5 is attached at the front of the vehicle body 2. The work implement 5 has a boom 3 and a bucket 4. The boom 3 is attached to the vehicle body 2 and extends from the vehicle body 2 in the forward direction. The boom 3 is supported by the vehicle body 2 in a manner that allows rotating up and down (elevating). A boom angle detection sensor 3*a* is disposed at a base end part of the boom 3. The boom angle detection sensor 3*a* detects the angle of the boom 3 with respect to the horizontal direction. In the present embodiment, an automatic lowering control is executed for automatically rotating and lowering the boom 3. The automatic lowering control is described below.

The bucket 4 has an opening part 4H and a claw 4C. The bucket 4 scoops a load of sand or gravel and the like with the claw 4C. The load scooped with the claw 4C enters into the bucket 4 from the opening part 4H. The bucket 4 is attached to the tip end part of the boom 3. The bucket 4 is supported by the boom 3 in a manner that allows rotating forward and backward. In the present description, rotating the bucket 4 to the rear is called "tilting" and rotating the bucket 4 forward is called "dumping."

The front wheels 6F and the rear wheels 6R are in contact with a road surface R. The wheel loader 1 travels due to the front wheels 6F and the rear wheels 6R rotating on the road surface R. The wheel loader 1 is steered by bending the vehicle body 2 between the front wheels 6F and the rear wheels 6R.

The boom cylinder 9 is coupled to the vehicle body 2 and the boom 3. The boom 3 rotates up and down due to the extension and contraction of the boom cylinder 9. The bucket cylinder 10 is coupled to the vehicle body 2 and an upper end part of a bell crank 11. The bell crank 11 is rotatably supported at the tip end part of a supporting member 12 that is fixed to the boom 3. A lower end part of the bell crank 11 is coupled to the bucket 4 via a coupling member 13. The bucket 4 tilts and dumps forward and backward around a portion supported by the boom 3 due to the extension and contraction of the bucket cylinder 10. A bucket angle detection sensor 4*a* is disposed at a tip end part of the supporting member 12. The bucket angle detection sensor 4*a* detects the angle of the bottom surface of the bucket 4 with respect to the horizontal direction.

The operating lever CL is used for raising and lowering the boom 3 due to the extension and contraction of the boom cylinder 9. In the present embodiment, the boom 3 is lowered when the operating lever CL is operated to the lowering side (forward in the present embodiment) relative to a neutral region. The boom 3 is raised when the operating lever CL is operated to the raising side (backward in the present embodiment) relative to the neutral position. The boom 3 is stopped when the operating lever CL is positioned in the neutral region between the raising side and the lowering side.

The operating lever CL is used for tilting or dumping the bucket 4 due to the extension and contraction of the bucket cylinder 10. In the present embodiment, the bucket 4 is tilted when the operating lever CL is operated to the tilt side (leftward in the present embodiment) relative to the neutral region. In addition, the bucket 4 is dumped when the operating lever CL is operated to the dump side (rightward in the present embodiment) relative to the neutral region. The bucket 4 is stopped when the operating lever CL is positioned in the neutral region between the tilt side and the dump side.

Control System of Wheel Loader 1

Figure 2:
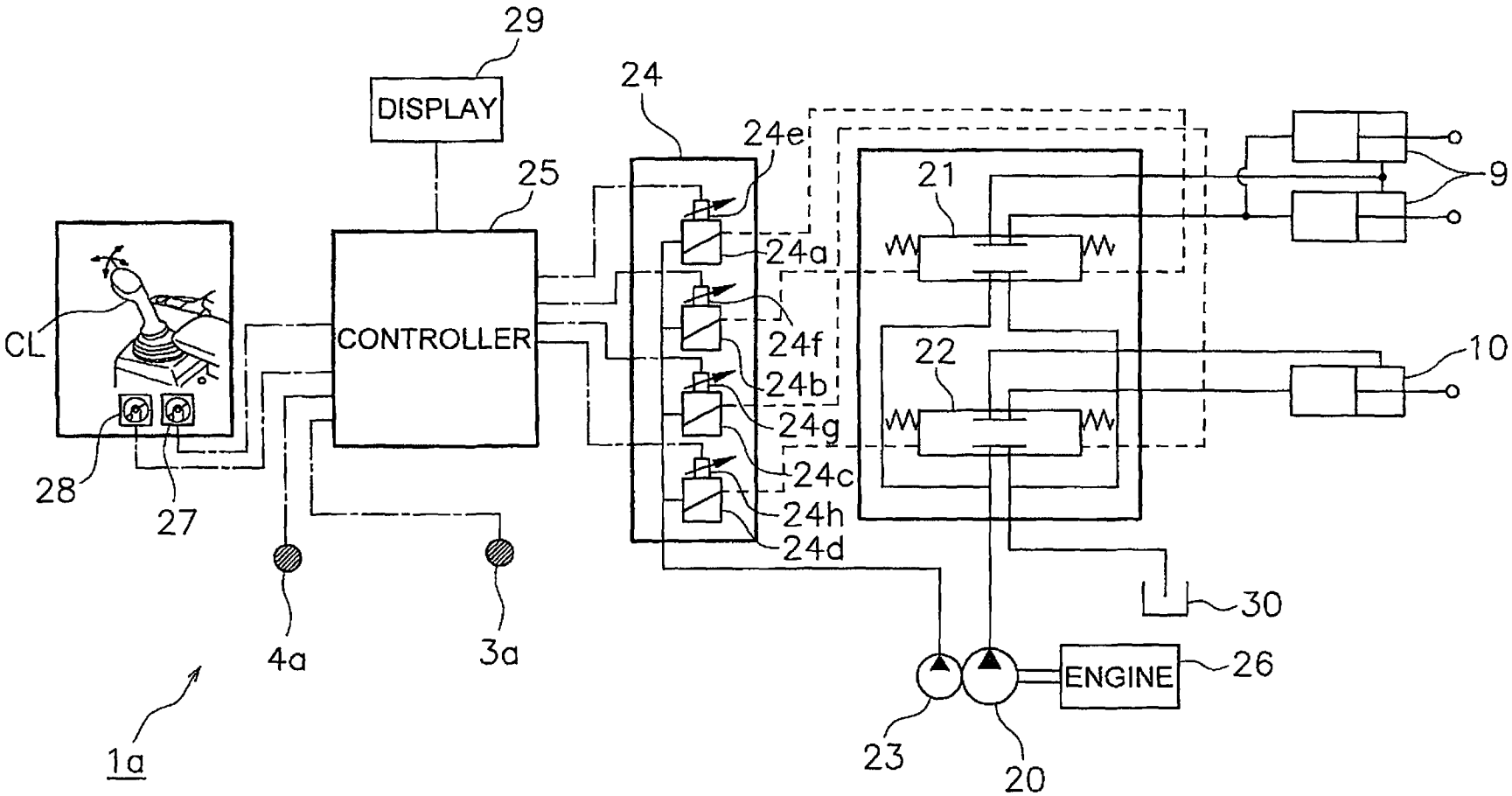
FIG. 2 is a block diagram illustrating a control system of the wheel loader.

FIG. 2 is a block diagram illustrating a control system 1*a* for controlling the operations of the wheel loader 1.

The control system 1*a* of the wheel loader 1 is provided with a work implement pump 20, a boom operation valve 21, a bucket operation valve 22, a pilot pump 23, a work implement electronic control valve 24, and a controller 25.

The work implement pump 20 is driven by an engine 26 as a drive force generation source mounted in the wheel loader 1. The work implement pump 20 discharges hydraulic fluid to the boom operation valve 21 and the bucket operation valve 22.

The boom operation valve 21 and the bucket operation valve 22 are both hydraulic pilot-type operation valves. The boom operation valve 21 is connected to the boom cylinder 9 and the bucket operation valve 22 is connected to the bucket cylinder 10.

The boom operation valve 21 is a switching valve for switching the respective flow paths of a head side port of the boom cylinder 9 and a bottom side port of the boom cylinder 9. In the present embodiment, the boom operation valve 21 has a floating position for enabling the head side and the bottom side of the boom cylinder 9 to communicate. When the boom operation valve 21 is positioned in the floating position, both the head side and the bottom side of the boom cylinder 9 are connected to a hydraulic fluid tank 30. The bucket operation valve 22 is a switching valve for switching the respective flow paths of a head side port of the bucket cylinder 10 and a bottom side port of the bucket cylinder 10.

The respective pilot pressure receiving parts of the boom operation valve 21 and the bucket operation valve 22 are connected to the work implement electronic control valve 24 via the pilot pump 23. The pilot pump 23 is driven by the engine 26. The pilot pump 23 supplies hydraulic fluid at a pilot pressure to the respective pilot pressure receiving parts of the boom operation valve 21 and the bucket operation valve 22 via the work implement electronic control valve 24.

The work implement electronic control valve 24 has a boom lowering control valve 24*a*, a boom raising control valve 24*b*, a bucket dump control valve 24*c*, and a bucket tilt control valve 24*d*. The boom lowering control valve 24*a* and the boom raising control valve 24*b* are connected respectively to a pair of pilot pressure receiving parts of the boom operation valve 21. The bucket dump control valve 24*c* and the bucket tilt control valve 24*d* are connected respectively to a pair of pilot pressure receiving parts of the bucket operation valve 22. Command signals from the controller 25 are inputted respectively to a solenoid command part 24*e* of the boom lowering control valve 24*a*, a solenoid command part 24*f* of the boom raising control valve 24*b*, a solenoid command part 24*g* of the bucket dump control valve 24*c*, and a solenoid command part 24*h* of the bucket tilt control valve 24*d*.

The boom operation valve 21, the boom lowering control valve 24*a*, the boom raising control valve 24*b*, and the boom cylinder 9 function as a boom driving part for raising and lowering the boom 3. The bucket operation valve 22, the bucket dump control valve 24*c*, the bucket tilt control valve 24*d*, and the bucket cylinder 10 function as a bucket driving part for tilting and dumping the bucket 4.

The controller 25 is, for example, a computer. The controller 25 includes a processing part such as a central processing unit (CPU) or the like, and a storage unit such as a read only memory (ROM) or the like. The controller 25 controls the operation of the work implement 5 by consecutively executing various commands stored in a computer program.

The controller 25 is connected to a boom lever potentiometer 27, a bucket lever potentiometer 28, a display 29, the boom angle detection sensor 3*a*, and the bucket angle detection sensor 4*a*.

The boom lever potentiometer 27 is provided on the operating lever CL. The boom lever potentiometer 27 detects the operation amount of the operating lever CL in the front-back direction. The bucket lever potentiometer 28 is provided on the operating lever CL. The bucket lever potentiometer 28 detects the operation amount of the operating lever CL in the left-right direction.

When the operating lever CL is operated to the raising side, the controller 25 switches the boom operation valve 21 thereby enabling the head side of the boom cylinder 9 to communicate with the hydraulic fluid tank 30 and enabling the bottom side of the boom cylinder 9 to communicate with the work implement pump 20. Consequently, the boom 3 is raised. When the operating lever CL is operated to the lowering side, the controller 25 switches the boom operation valve 21 thereby enabling the bottom side of the boom cylinder 9 to communicate with the hydraulic fluid tank 30 and enabling the head side of the boom cylinder 9 to communicate with the work implement pump 20. Consequently, the boom 3 is lowered by rotating. In the above cases, the controller 25 drives the boom 3 at a driving speed corresponding to the operation amount of the operating lever CL.

When the operating lever CL is operated to the tilt side, the controller 25 switches the bucket operation valve 22 thereby enabling the head side of the bucket cylinder 10 to communicate with the hydraulic fluid tank 30 and enabling the bottom side of the bucket cylinder 10 to communicate with the work implement pump 20. Consequently, the bucket 4 is tilted forward. When the operating lever CL is operated to the dump side, the controller 25 switches the bucket operation valve 22 thereby enabling the bottom side of the bucket cylinder 10 to communicate with the hydraulic fluid tank 30 and enabling the head side of the bucket cylinder 10 to communicate with the work implement pump 20. Consequently, the bucket 4 dumps to the rear. In the above cases, the controller 25 drives the bucket 4 at a driving speed corresponding to the operation amount of the operating lever CL.

In the present embodiment, the controller 25 starts the execution of the automatic lowering control for automatically rotating and lowering the boom 3 when the operating lever CL is operated by a predetermined operation amount or greater to the lowering side. The lowering speed of the boom 3 during the automatic lowering control can be inputted by the operator on a setting screen displayed on the display 29. For example, a touch panel-type monitor can be used on the display 29. The controller 25 sets the speed inserted on the display 29 as the lowering speed during the automatic lowering control. The controller 25 controls a boom driving part so that the lowering speed to which the boom 3 is set is maintained during the execution of the automatic lowering control.

Here, the controller 25 sets the boom cylinder 9 to a floating state when it is detected that the bucket 4 has reached a grounding position during the execution of the automatic lowering control. The floating state is a state in which the head side and the bottom side of the boom cylinder 9 and the tanks are in communication with each other. The controller 25 sets the boom cylinder 9 to the floating state by switching the boom operation valve 21 to a floating position. The bucket 4 is not held by the boom cylinder 9 because the boom cylinder 9 in the floating state is expandable. As a result, the bucket 4 enters a state of being placed on the ground surface under its own weight. When the wheel loader 1 moves in reverse under the above state, leveling work of the ground surface can be performed effectively with the bucket 4.

The controller 25 detects that the bucket 4 has come into contact with the ground on the basis of the angles of the respective boom angle detection sensor 3*a* and the bucket angle detection sensor 4*a*. Specifically, the attitude of the boom cylinder 9 is sensed on the basis of an output value of the boom angle detection sensor 3*a*, and the attitude of the bucket 4 is sensed on the basis of an output value of the bucket angle detection sensor 4*a*, whereby it can be determined whether or not any portion of the bucket 4 has reached the grounding position.

Automatic Lowering Control

Figure 3:
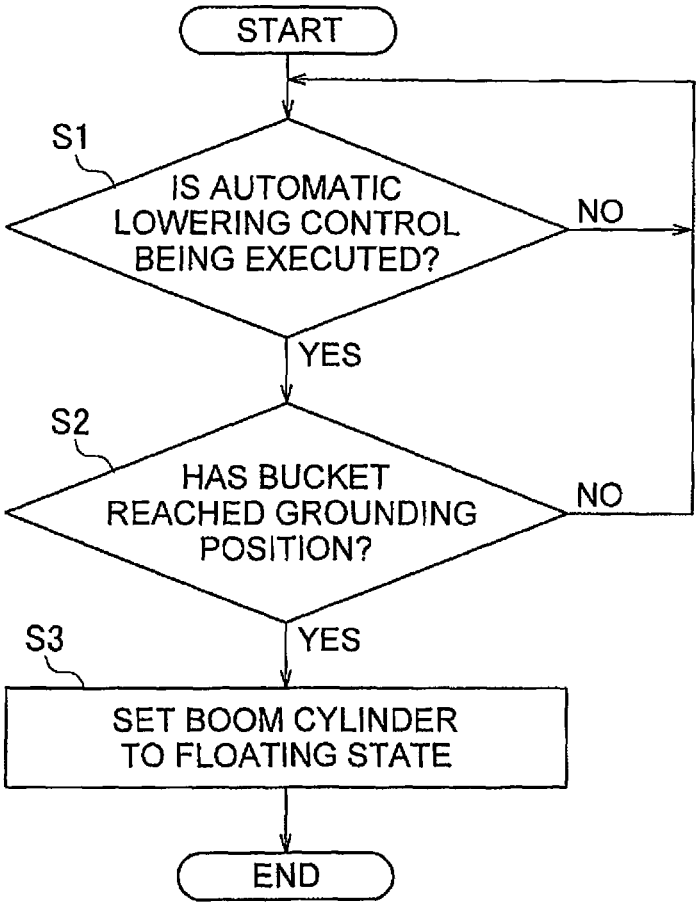
FIG. 3 is a flow chart for explaining an automatic lowering control.

The automatic lowering control performed by the controller 25 will be explained with reference to the flow chart illustrated in FIG. 3.

In step S1, the controller 25 determines whether the automatic lowering control is being executed. The processing advances to step S2 when the automatic lowering control is being executed, and the processing repeats step S1 when the automatic lowering control is not being executed.

In step S2, the controller 25 determines whether or not the bucket 4 has reached the grounding position on the basis of the respective angles of the boom angle detection sensor 3*a* and the bucket angle detection sensor 4*a*. The processing advances to step S3 when the bucket 4 has reached the grounding position, and the processing returns to step S1 when the bucket has not reached the grounding position.

In step S3, the controller 25 sets the boom cylinder 9 to the floating state by switching the boom operation valve 21 to the floating position. As a result, the bucket 4 enters a state of being placed on the ground surface under its own weight. Thereafter, the controller 25 ends the automatic lowering control.

Characteristics (1) The controller 25 sets the boom cylinder 9 to the floating state when it is detected that the bucket 4 has reached the grounding position during the execution of the automatic lowering control for automatically lowering the boom 3. Therefore, the bucket 4 can be brought into contact with the ground easily and the shock when the bucket 4 comes into contact with the ground can be limited because the boom 3 is able to enter the floating state at the timing that the bucket 4 brought into contact with the ground during the execution of the automatic lowering control.

(2) The controller 25 detects that the bucket 4 is in contact with the ground on the basis of the respective angles of the boom angle detection sensor 3*a* and the bucket angle detection sensor 4*a*. Therefore, the shock when the bucket 4 is brought into contact with the ground can be further limited because the timing for the bucket 4 into contact with the ground can be sensed with good accuracy.

Other Embodiments

While the controller 25 detects that the bucket 4 is in contact with the ground on the basis of the respective angles of the boom angle detection sensor 3*a* and the bucket angle detection sensor 4*a* in the above embodiment, the fact that the bucket 4 has come into contact with the ground can be detected with various methods. For example, the controller 25 can detect that the bucket 4 is in contact with the ground on the basis of the angle of the boom angle detection sensor 3*a* only. Moreover, the controller 25 can detect that the bucket 4 is in contact with the ground on the basis of the stroke amount of the boom cylinder 9. In this case, the wheel loader 1 may be provided with a boom stroke sensor for the boom cylinder 9. Moreover, the controller 25 can detect that the bucket 4 is in contact with the ground on the basis of the stroke amount of the boom cylinder 9 and the stroke amount of the bucket cylinder 10. In this case, the wheel loader 1 may be provided with a boom stroke sensor for the boom cylinder 9 for detecting the stroke amount of the boom cylinder 9, and a bucket stroke sensor for detecting the stroke amount of the bucket cylinder 10. Furthermore, the controller 25 can detect that the bucket 4 is in contact with the ground on the basis of the fact that hydraulic pressure at the bottom side of the boom cylinder 9 is equal to or less than a predetermined threshold. In this case, the wheel loader 1 may be provided with a hydraulic pressure sensor for sensing the hydraulic pressure at the bottom side of the boom cylinder 9.

While the controller 25 executes the automatic lowering control when the operating lever CL is moved by a predetermined operation amount or greater toward the lowering side, the execution starting condition of the automatic lowering control is not limited in this way. For example, the controller 25 may execute the automatic lowering control when the operating lever CL is returned to a neutral position after the operating lever CL has been moved by the predetermined operation amount or greater toward the lowering side. Moreover, the controller 25 may execute the automatic lowering control when the operator presses an execution button for the automatic lowering control after the operating lever CL has been operated by the predetermined operation amount or more to the lowering side.

While the controller 25 sets the speed inputted on the setting screen displayed on the display 29 as the predetermined speed for the automatic lowering control, the present invention is not limited in this way. For example, the controller 25 may set the predetermined speed in response to the position of a dial for setting the predetermined speed for the automatic lowering control.

While the controller 25 sets the boom cylinder 9 to the floating state when it is detected that the bucket 4 has reached the grounding position, the present invention is not limited in this way. The controller 25 may set the boom cylinder 9 to the floating state when it is detected that the bucket 4 has reached a predetermined position. The predetermined position is preferably set to a position where the bucket 4 is near the ground surface. In this case, the bucket 4 can be brought into contact with the ground easily and the shock when the bucket 4 comes into contact with the ground can be limited.

What is claimed is:

1. A work vehicle comprising:

a vehicle body;

a work implement including a boom attached to the vehicle body and an attachment attached to a tip end part of the boom;

a first actuator configured to rotate the boom up and down;

an electronic controller configured to execute an automatic lowering control in order to automatically rotate and lower the boom; and a sensor configured to detect a position of the attachment, the electronic controller being further configured to switch the first actuator from the automatic lowering control to a floating state upon the sensor detecting the attachment reaching a predetermined position during an execution of the automatic lowering control.

2. The work vehicle according to claim 1, wherein the predetermined position is a position in which the attachment is in contact with the ground.

3. The work vehicle according to claim 1, wherein the electronic controller is further configured to detect that the attachment has reached the predetermined position based on an angle of the first actuator.

4. The work vehicle according to claim 1, further comprising:

a second actuator configured to rotate the attachment forward and backward, the electronic controller being further configured to detect that the attachment has reached the predetermined position based on an angle of the first actuator and an angle of the second actuator.

5. The work vehicle according to claim 1, wherein the electronic controller is further configured to detect that the attachment has reached the predetermined position based on a stroke amount of the first actuator.

6. The work vehicle according to claim 1, further comprising:

a second actuator configured to rotate the attachment forward and backward, the electronic controller being further configured to detect that the attachment has reached the predetermined position based on a stroke amount of the first actuator and a stroke amount of the second actuator.

7. The work vehicle according to claim 1, further comprising:

a hydraulic pressure sensor configured to sense a hydraulic pressure at a bottom side of the first actuator, the electronic controller being further configured to detect that the attachment has reached the predetermined position based on the hydraulic pressure sensed by the hydraulic pressure sensor being equal to or less than a predetermined threshold.

8. The work vehicle according to claim 1, further comprising:

an operating device configured to elevate the boom, the electronic controller being further configured to start the execution of the automatic lowering control when the operating device is operated to a predetermined operation amount or more on a lowering side.

9. The work vehicle according to claim 1, further comprising:

a display configured to display a setting screen usable to set a lowering speed of the boom for the automatic lowering control, the electronic controller being further configured to set a speed inputted on the display as the lowering speed.

10. The work vehicle according to claim 1, further comprising:

a dial configured to set a lowering speed of the boom for the automatic lowering control, the electronic controller being further configured to set a speed corresponding to the position of the dial as the lowering speed.

11. The work vehicle according to claim 1, wherein the electronic controller is further configured to set the first actuator to be expandable by enabling a bottom side and a top side of the first actuator to communicate.

12. A work method for a work vehicle, the method comprising:

executing an automatic lowering control, with an electronic controller, to automatically rotate and lower a boom attached to a vehicle body;

detecting with a sensor whether an attachment attached to a tip end part of the boom has reached a predetermined position; and switching a first actuator configured to rotate the boom up and down from the automatic lowering control to a floating state, with the electronic controller, upon the sensor detecting that the attachment has reached the predetermined position.

13. The control method for a work vehicle according to claim 12, wherein the predetermined position is a position in which the attachment is in contact with the ground.

14. The control method for a work vehicle according to claim 12, wherein whether the attachment has reached the predetermined position is detected based on an angle of the first actuator.

15. The control method for a work vehicle according to claim 12, wherein whether the attachment has reached the predetermined position is detected based on an angle of the first actuator and an angle of a second actuator configured to rotate the attachment forward and backward.

16. The control method for a work vehicle according to claim 12, wherein whether the attachment has reached the predetermined position is detected based on a stroke amount of the first actuator.

17. The control method for a work vehicle according to claim 12, wherein whether the attachment has reached the predetermined position is detected based on a stroke amount of the first actuator and a stroke amount of a second actuator configured to rotate the attachment forward and backward.

18. The control method for a work vehicle according to claim 12, wherein whether the attachment has reached the predetermined position is detected based on whether a hydraulic pressure at a bottom side of the first actuator being equal to or less than a predetermined threshold.

19. The control method for a work vehicle according to claim 12, wherein the execution of the automatic lowering control is started when an operating device usable to elevate the boom is operated to a predetermined operation amount or more on a lowering side.

20. The control method for a work vehicle according to claim 12, wherein a speed inputted to a display that displays a setting screen usable to set a lowering speed of the boom for the automatic lowering control, is set as the lowering speed.

* * * * *